US011208833B2

(12) United States Patent
Tarrega Klein

(10) Patent No.: US 11,208,833 B2
(45) Date of Patent: Dec. 28, 2021

(54) DEVICE FOR SECURING PANES OF GLASS FOR SLIDING DOORS

(71) Applicant: KLEIN IBERICA S.A.U., Montcada i Reixac (ES)

(72) Inventor: Marc Tarrega Klein, Barcelona (ES)

(73) Assignee: KLEIN IBERICA S.A.U., Montcada I Reixac (ES)

( * ) Notice: Subject to any disclaimer, the term of this patent is extended or adjusted under 35 U.S.C. 154(b) by 52 days.

(21) Appl. No.: 16/633,720

(22) PCT Filed: Aug. 2, 2018

(86) PCT No.: PCT/ES2018/070542
§ 371 (c)(1),
(2) Date: Jan. 24, 2020

(87) PCT Pub. No.: WO2019/025658
PCT Pub. Date: Feb. 7, 2019

(65) Prior Publication Data

US 2020/0208451 A1 Jul. 2, 2020

(30) Foreign Application Priority Data

Aug. 2, 2017 (ES) ..... ES201730930U

(51) Int. Cl.
*E05D 15/00* (2006.01)
*E05D 15/06* (2006.01)
*E05D 5/02* (2006.01)

(52) U.S. Cl.
CPC ..... *E05D 15/0652* (2013.01); *E05D 15/0634* (2013.01); *E05D 5/0246* (2013.01); (Continued)

(58) Field of Classification Search
CPC ..... E05D 15/00; E05D 15/1005; E05D 15/28; E05D 15/0608; E05D 15/0626; (Continued)

(56) References Cited

U.S. PATENT DOCUMENTS 2,940,113 A * 6/1960 Riser ..... E05D 15/063 16/105
3,105,272 A * 10/1963 Tucker, Jr. ..... E05D 15/0634 49/411

(Continued)

FOREIGN PATENT DOCUMENTS

DE 3616242 C1 * 1/1988 ..... E05D 15/0634
DE 3800444 A1 7/1989

(Continued)

OTHER PUBLICATIONS

International Search Report and Written Opinion for Corresponding International Application No. PCT/ES2018/070542 (dated Jan. 17, 2019) (9 Pages).

*Primary Examiner* — Chuck Y Mah
(74) *Attorney, Agent, or Firm* — Lucas & Mercanti, LLP

(57) ABSTRACT

The invention relates to a device for securing panes of glass for sliding doors, made up of a rear plate (3) on which a rolling element (2) is supported which is configured to enable the movement of the securing device (1) along a profile (F) of a sliding door (P); and a first front plate (4) and a second front plate (5) facing the rear plate (3) and able to be coupled to it, defining an intermediate mortise (7) for securing a pane of glass (H). Said securing device (1) comprises a third front plate (6) facing the rear plate (3) and able to be coupled to it, arranged between the first front plate (4) and the second front plate (5).

17 Claims, 12 Drawing Sheets

(52) U.S. Cl.
CPC ... *E05Y 2201/684* (2013.01); *E05Y 2600/502* (2013.01); *E05Y 2800/672* (2013.01)

(58) Field of Classification Search
CPC ..... E05D 15/264; E05D 15/06; E05D 15/063; E05D 15/0643; E05D 15/0647; E05D 15/165; E05D 15/0621; E05D 15/0653; E05D 15/26; E05D 15/262; E05D 15/0652; E05D 15/0634; E05D 15/0639; E05D 5/0246; E05Y 2201/64; E05Y 2201/688; E05Y 2201/708; E05Y 2201/612; E05Y 2201/614; E05Y 2900/531; E05Y 2900/532; E05Y 2900/131; E05Y 2900/132; E05Y 2900/142; E05Y 2201/684; E05Y 2600/504; E05Y 2800/672; E06B 3/50; E06B 3/485; E06B 9/36; E06B 3/42; E06B 3/46; E06B 3/4609; E06B 3/4636; B60J 5/06; B60J 5/062; B60J 5/047; B60J 5/12; B60J 5/04; Y10T 16/364; Y10T 16/3813; Y10T 16/3837; Y10T 16/384; Y10T 16/3825; A47H 2023/025; A47H 1/04; A47H 15/00; A47H 15/02; A47H 15/04
See application file for complete search history.

(56) References Cited

U.S. PATENT DOCUMENTS 3,425,162 A * 2/1969 Halpern ..... E05D 15/0634 49/425
3,828,394 A * 8/1974 Horgan, Jr. ..... E05D 7/081 16/241
4,653,127 A * 3/1987 Baus ..... E05D 15/0634 4/610
5,070,575 A * 12/1991 Redman ..... E05D 15/0639 16/96 R
5,090,171 A * 2/1992 Kano ..... E04B 2/827 52/243.1
5,598,666 A * 2/1997 Kurth ..... A47K 3/34 4/557
7,891,052 B2 * 2/2011 Haab ..... E05F 5/003 16/98
8,070,361 B2 * 12/2011 Schroeder ..... F16C 29/12 384/57
10,596,884 B2 * 3/2020 Biesenbruck ..... B60J 5/065
2001/0010426 A1 * 8/2001 Migli ..... E05D 15/063 292/1
2010/0101150 A1 * 4/2010 Huang ..... E05D 15/0639 49/409
2011/0041286 A1 * 2/2011 Busch ..... E05F 15/632 16/91
2014/0143980 A1 5/2014 Chang et al.

FOREIGN PATENT DOCUMENTS

DE 102011087694 A1 * 11/2012 ..... E05D 15/063
EP 0111155 A2 * 6/1984 ..... E05D 15/0634
EP 0626495 A1 11/1994
EP 1764468 A2 3/2007
ES 2293795 A1 3/2008
GB 990057 A * 4/1965 ..... E05D 15/0634
GB 2371326 A * 7/2002 ..... E05D 15/0634

* cited by examiner

DEVICE FOR SECURING PANES OF GLASS FOR SLIDING DOORS

CROSS REFERENCE TO RELATED APPLICATION

This Application is a 371 of PCT/ES2018/070542 filed on Aug. 2, 2018, which claims the benefit of Spanish Patent Application No. U201730930, filed Aug. 2, 2017, which is incorporated herein by reference.

FIELD OF THE INVENTION

The present invention relates to a device for securing panes of glass for sliding doors generally within the fields of construction and/or building and, more especially, for those that enable the movement of one or more panes of glass suspended from said securing device along a guide profile.

BACKGROUND OF THE INVENTION

Currently, a wide variety of devices for securing panes of glass are known, also called "suspension devices" or "clamps", especially applicable to the type of sliding doors indicated previously.

The document ES2293795A1 shows an example of these devices which relates to a mechanism for sliding panes of glass. Said mechanism comprises a suspension device made up of a rear plate in turn facing two front plates, between which an intermediate mortise is defined to secure a sliding pane of glass. On the rear plate a rolling element, or wheel, is in turn supported, configured to enable the movement of the securing device along an upper guide profile of a sliding door. Said rolling element is housed in front of the inner face of the rear plate, laterally flanked by the two front plates.

Although the mechanism for sliding panes of glass shown in document ES2293795A1 is highly functional and compact, current needs require the incorporation of a wider variety of adjustment and/or safety elements into these types of devices, as well as a greater architectural integration and level of aesthetic finish of the resulting sliding doors. At the same time, all of this guarantees the use of as few elements and/or components as possible, as well as the reduction of the manufacturing costs of the resulting device.

The present invention enables the current needs in this field to be met by means of a device for securing panes of glass for sliding doors that incorporates a multifunctional and independent plate that is easy to manufacture and assemble, facing the rear plate and arranged between the front plates. In turn, the configuration of the resulting device enables the height of the rolling element to be adjusted, a safety mechanism to be arranged to ensure the anti-derailment of the pane of glass, lateral stops to be integrated to enable the use of closing and/or retaining shock absorbers, enable the separate manufacturing of the different plates, as well as combine plates with different materials and/or colours in order to obtain finishes with better quality and/or aesthetic level.

DESCRIPTION OF THE INVENTION

The present invention relates to a device for securing panes of glass, also called a suspension device or clamp, made up of:

- a rear plate on which a rolling element is supported which is configured to enable the movement of the securing device along a profile of a sliding door; and

- a first front plate and a second front plate facing the rear plate and able to be coupled to it, defining an intermediate mortise for securing a sliding pane of glass.

The number of panes of glass, the mode of installation thereof, the type of profile and the configuration of the sliding door admit several construction variations, all of these compatible with the securing device of the present invention. In a non-limiting manner, the number of panes of glass can be one or more, with the possibility of combining fixed panes of glass with mobile (sliding) panes of glass. Likewise, the assembly of the profile can be in a visible or embedded installation, whether it be laterally fastened to the wall, fastened to the ceiling, or directly to a false ceiling, among other types of assembly.

The securing device of the present invention is characterised in that it comprises a third front plate facing the rear plate and able to be coupled to it, arranged between the first front plate and the second front plate. Said third front plate makes up a multifunctional plate that can be manufactured separately with respect to the first front plate and the second front plate and, therefore, facilitates the manufacturing and assembly processes of the resulting securing device.

Likewise, the separate manufacturing of the main components of the securing device enables materials with a different nature and/or visual appearance to be used, the combination of which enables finishes with better quality and/or a higher aesthetic level to be obtained. According to a preferred combination, the third front plate is made of plastic material (for example; technical plastic material, such as polyacetals or polyamides, among others) having a certain colour, while the rear plate, the first front plate and the second front plate are made of metal (for example; aluminium), the latter being a different colour than the third front plate.

As for the multifunctional character of the third front plate, the role thereof is highlighted as far as it enables the height of the rolling element to be adjusted, in order to ensure the anti-derailment of the pane of glass, as well as enabling the use of closing and/or retaining shock absorbers.

Preferably, the rolling element comprises an eccentric shaft in order to enable, in collaboration with the third front plate, the height of said rolling element to be adjusted with respect to the device. This enables the sliding pane secured to the device to be raised or lowered in order to adjust it at the desired position with respect to the floor or with respect to a lower rail or sliding guide.

In turn, the rear plate comprises a supporting hole configured to receive the eccentric shaft of the rolling element through it.

Likewise, the rear plate comprises:

- at least one first bushing facing a first hole of the first front plate in order to enable said first front plate to be coupled to the rear plate by using a first screw; and
- at least one second bushing facing a second hole of the second front plate in order to enable said second front plate to be coupled to the rear plate by using a second screw.

Preferably, the rear plate comprises at least one auxiliary hole arranged around the rolling element in order to enable the coupling of the third front plate.

Preferably, the rear plate comprises an auxiliary slit facing a first slit of the first front plate and a second slit of the second front plate, in order to enable a separator to be inserted between said slits. Said separator enables the use of panes of glass with different thicknesses for a specific securing device.

Preferably, the third front plate comprises a central hole. According to a preferred embodiment, said central hole faces the supporting hole of the front plate in order to receive an adjusting end of the eccentric shaft of the rolling element through it. Said adjusting end can have a hexagonal shape compatible with a nut driver, and other shapes compatible with similar tools such as screwdrivers, etc. Thus, the operator can easily access the front portion of the securing device and use said tools on the adjusting end, making the eccentric shaft rotate until it is left in the desired position. This position in turn determines the final position of the rolling element with respect to the securing device and, therefore, the position of the lower end of the sliding pane of glass with respect to the floor.

Thus, once said adjustment position is reached, the operator has to fasten the eccentric shaft to the third front plate. To do so, preferably, the third front plate comprises a fastening hole that opens into the central hole, in order to enable the fastening of the eccentric shaft of the rolling element by means of a fastening screw.

Preferably, the third front plate comprises at least one joining hole in order to enable the coupling of said third front plate to the rear plate. According to a preferred embodiment, said joining hole faces the auxiliary hole of the rear plate in order to enable the coupling of said third front plate to the rear plate by using a third screw.

Preferably, the third front plate comprises:

- a first lateral stop that protrudes perpendicularly with respect to a front face of the third front plate; and
- a second lateral stop, opposite from the first lateral stop, which protrudes perpendicularly with respect to said front face.

These lateral stops enable the securing device to work in collaboration with other elements mounted in the door, such as closing and/or retaining shock absorbers. Most of the time, said elements have the function of assisting the movement of the pane of glass, progressively reducing the speed thereof as it is closed in order to prevent banging, and at the same time pulling on it in the last moments to leave it properly closed.

Preferably, the third front plate comprises:

- at least one threaded bushing vertically inserted into at least one of the lateral stops; and
- a safety screw configured to be threaded into the threaded bushing protruding vertically with respect to an upper face of the third front plate in order to ensure the anti-derailment of the pane of glass.

According to a preferred embodiment, the threaded bushing is made of metal material inserted into a third front plate made of injected plastic.

The function of the safety screw is mainly related to the tasks of assembling and repairing the door. Specifically, it can happen that, during the handling of the pane of glass in the indicated situations, the operator lifts it too much causing the rolling element to become uncoupled from the corresponding rolling profile or rail enabled in the assembly profile. This can cause the pane to come out of the profile and/or fall, being able to cause accidents or the breaking of the glass. In order to prevent these problems, the safety screw can be adjusted on the threaded bushing, making it protrude vertically with the desired measurement. Thus, if the pane of glass swings too far laterally, the upper end of the safety screw butts against the profile or another element attached to it in order to stop said swinging.

In order to ensure a suitable joint that is robust and compact between the rear plate and the third front plate, it preferably comprises an upper extension that has a longitudinal recess configured to fit with the rear plate, giving rise to a configuration of said third front plate that has an inverted "L" shape.

BRIEF DESCRIPTION OF THE DRAWINGS

What follows is a very brief description of a series of drawings that aid in better understanding the invention, and which are expressly related to two embodiments of said invention that are presented by way of non-limiting examples of the same.

DETAILED DESCRIPTION OF THE INVENTION

Figure 1:
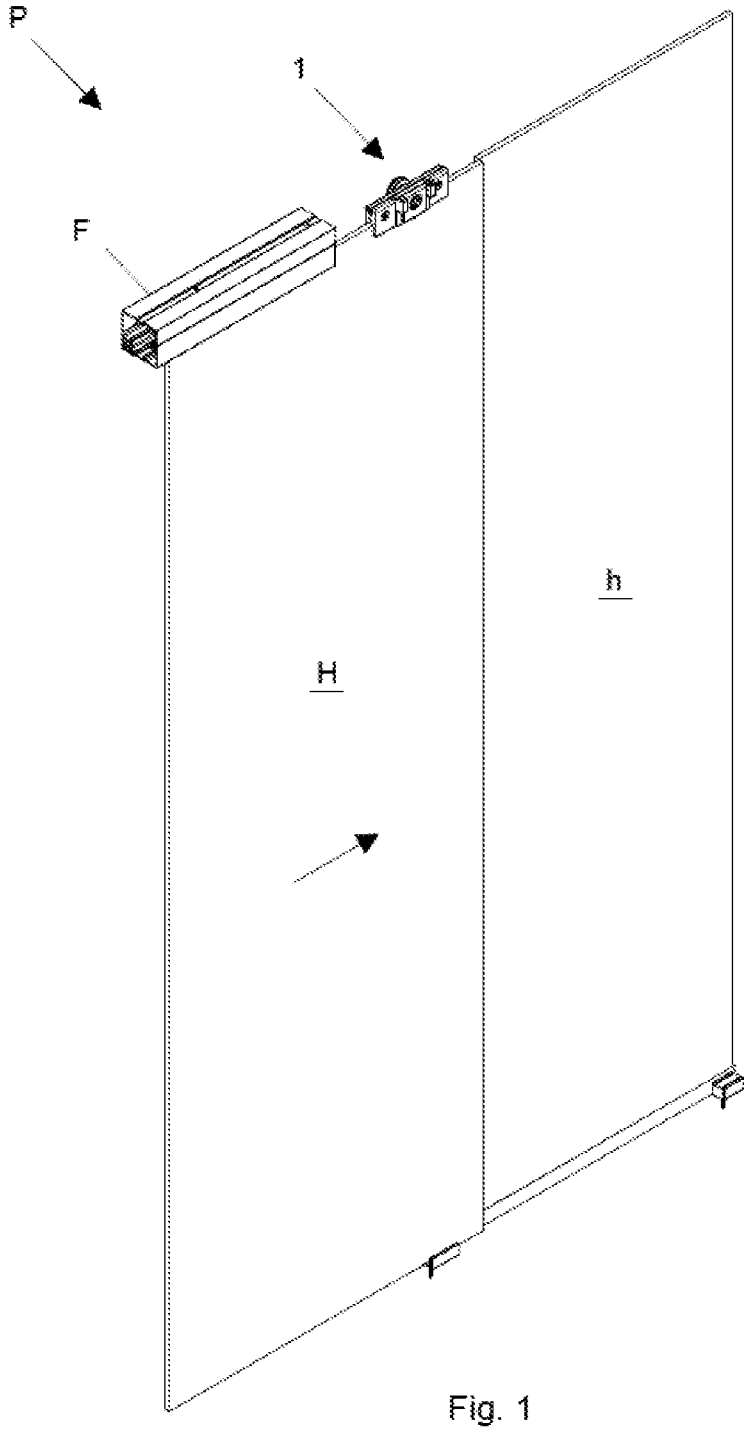
FIG. 1 shows a perspective view of a sliding door with the securing device of the present invention.

FIG. 1 shows an example of application of the securing device (1) of the present invention in a sliding door (P) comprising a sliding pane of glass (H) and a fixed pane of glass (h). As seen, the sliding pane of glass (H) is suspended from the securing device (1), which is in turn housed in a profile (F), partially illustrated. The securing device (1) is configured to move along the profile (F).

Figure 2:
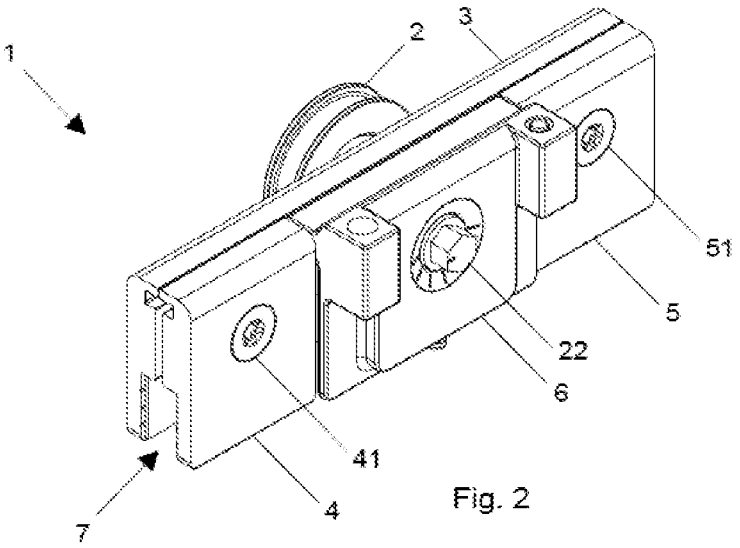
FIG. 2 shows a front perspective view of the securing device of the present invention, according to a first embodiment.
Figure 3:
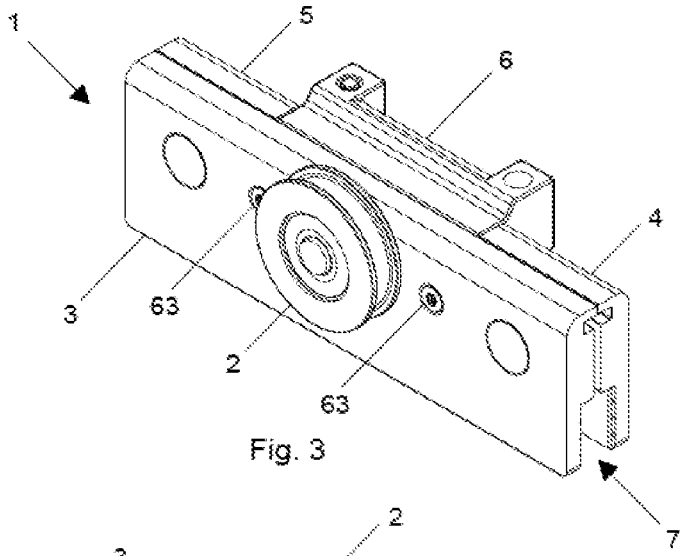
FIG. 3 shows a rear perspective view of the securing device of FIG. 2.
Figure 4:
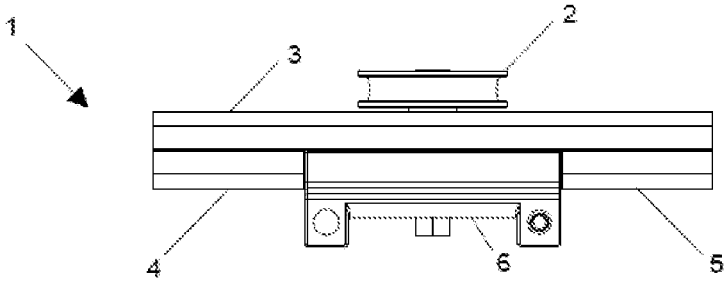
FIG. 4 shows a plan view of the securing device of FIG. 2.

As seen in FIGS. 2-4, the securing device (1) is made up of:

- a rear plate (3) on which a rolling element (2) is supported which is configured to enable the movement of the securing device (1) along a profile (F) of a sliding door (p); and
- a first front plate (4) and a second front plate (5) facing the rear plate (3) and able to be coupled to it, defining an intermediate mortise (7) for securing a sliding pane of glass (H).

The securing device (1) comprises a third front plate (6) facing the rear plate (3) and able to be coupled to it, arranged between the first front plate (4) and the second front plate (5).

Figure 5:
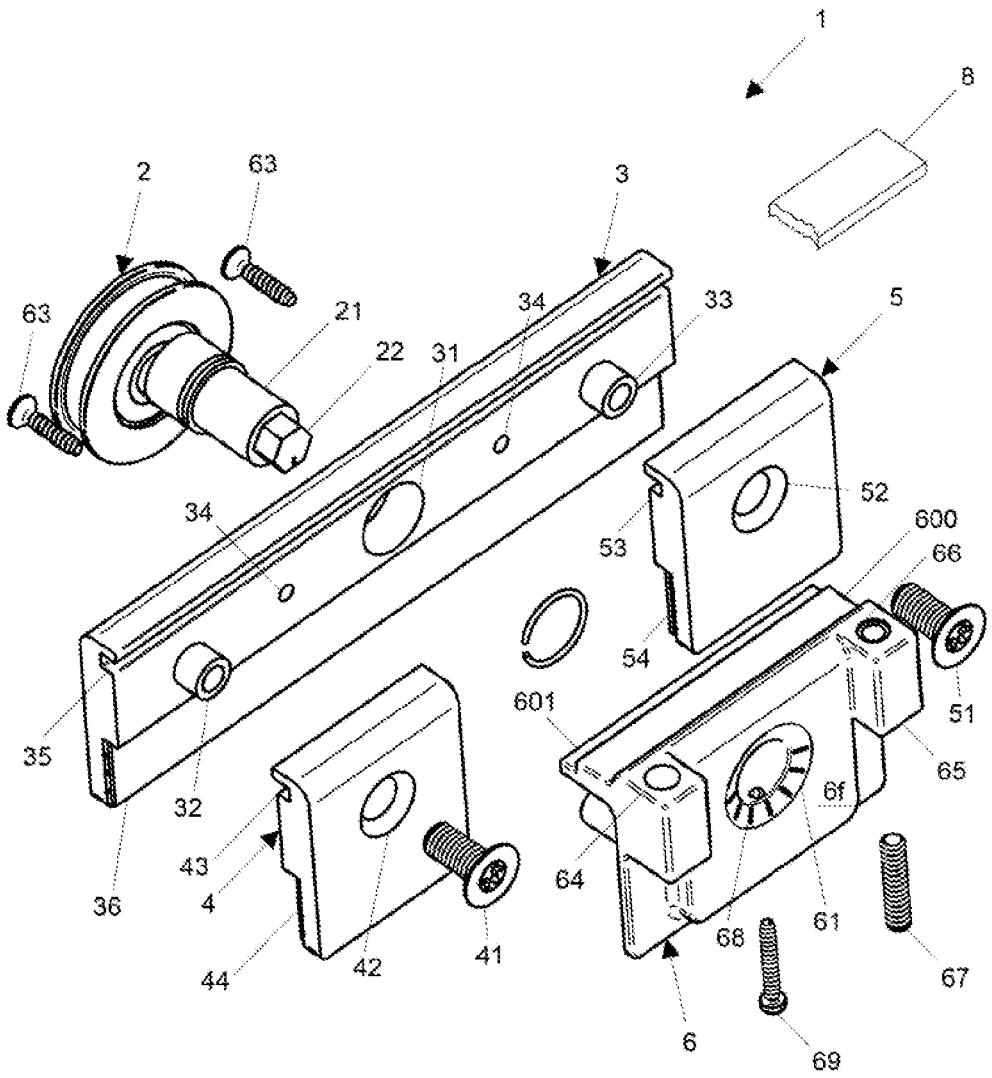
FIG. 5 shows an exploded perspective view of the securing device of FIG. 2.

FIG. 5 shows the different components that make up the securing device (1) of the present invention in greater detail.

As seen, the rolling element (2) comprises an eccentric shaft (21) in order to enable, in collaboration with the third front plate (6), the height of said rolling element (2) to be adjusted with respect to the device (1).

In turn, the rear plate (3) comprises a supporting hole (31) configured to receive the eccentric shaft (21) of the rolling element (2) through it.

Likewise, the rear plate (3) comprises:

- a first bushing (32) facing a first hole (42) of the first front plate (4) in order to enable said first front plate (4) to be coupled to the rear plate (3) by using a first screw (41); and
- a second bushing (33) facing a second hole (52) of the second front plate (5) in order to enable said second front plate (5) to be coupled to the rear plate (3) by using a second screw (51).

The rear plate (3) comprises at least two auxiliary holes (34) arranged around the rolling element (2) in order to enable the coupling of the third front plate (6).

Likewise, the rear plate (3) comprises an auxiliary slit (35) facing a first slit (43) of the first front plate (4) and a second slit (53) of the second front plate (5), in order to enable a separator (8) to be inserted between said slits (35, 43, 53). Said separator (8) enables panes of glass with different thicknesses ($e_1$, $e_2$) to be used for a specific securing device (1), FIGS. 12 and 13.

For better securing of the pane of glass (H), the rear plate (3) comprises a pressure band (36) that works in collaboration with a first pressure band (44) of the first front plate (4) and with a second pressure band (54) of the second front plate (5), pressing on the upper edge of the pane of glass (H).

The third front plate (6) comprises a central hole (61) facing the supporting hole (31) of the rear plate (3) in order to receive an adjusting end (22) of the eccentric shaft (21) of the rolling element (2) through it. Said adjusting end (22) has a hexagonal shape compatible with a nut driver in order to make it easier for the operator to adjust the height of the pane of glass (H) with respect to the floor. This is achieved by making the eccentric shaft (21) rotate through the adjusting end (22) thereof until it is left in the desired position. Once said adjustment position is reached, the operator has to fasten the eccentric shaft (21) to the third front plate (6). To do so, the third front plate (6) comprises a fastening hole (68) that opens into the central hole (61), and that enables the fastening of the eccentric shaft (21) of the rolling element (2) by means of a fastening screw (69).

Figure 7:
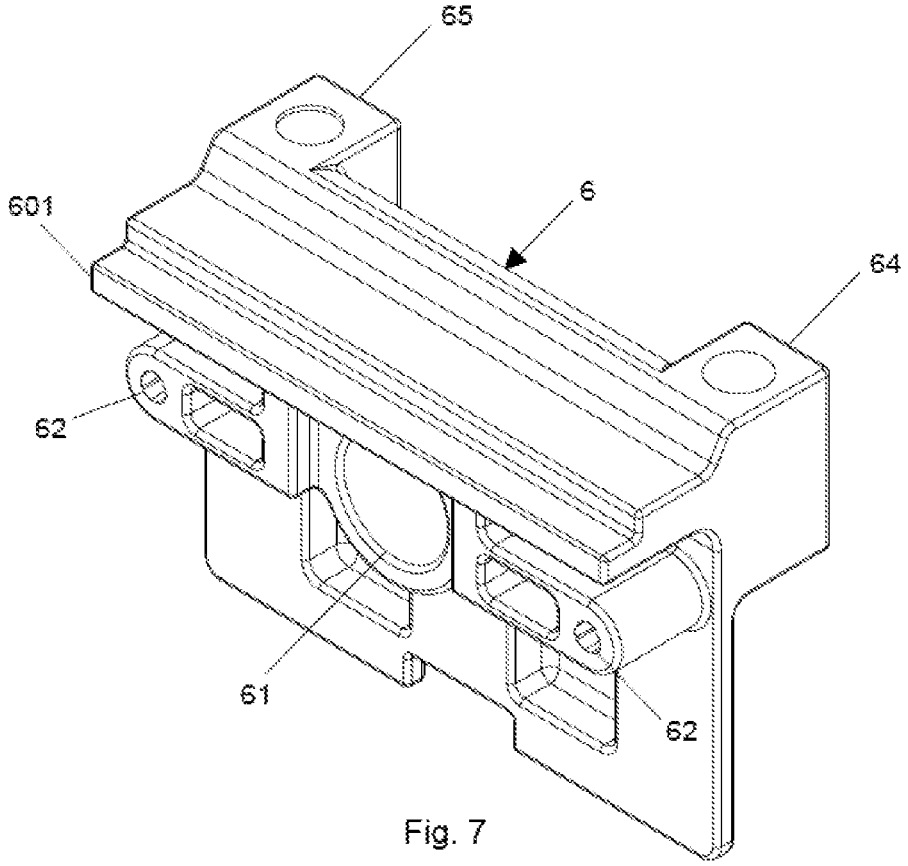
FIG. 7 shows a rear perspective view of the third front plate.
Figure 8A:
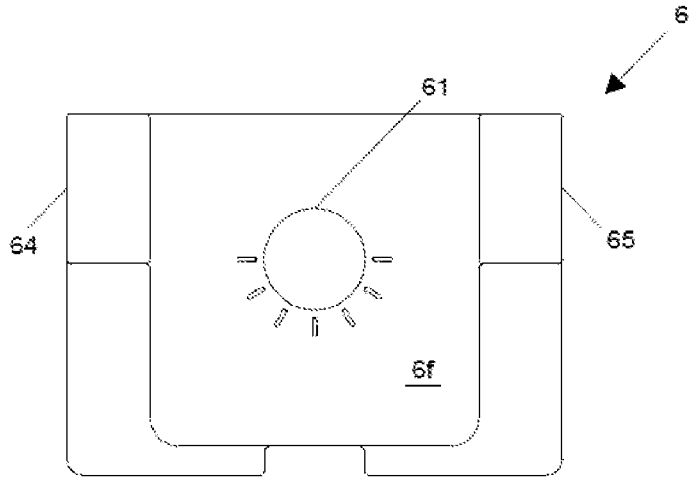
FIG. 8*a* shows a front elevation view of the third front plate.
Figure 8B:
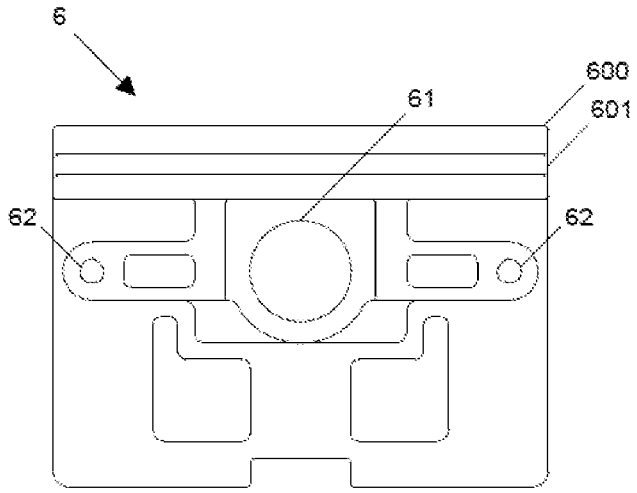
FIG. 8*b* shows a rear elevation view of the third front plate.
Figure 8C:
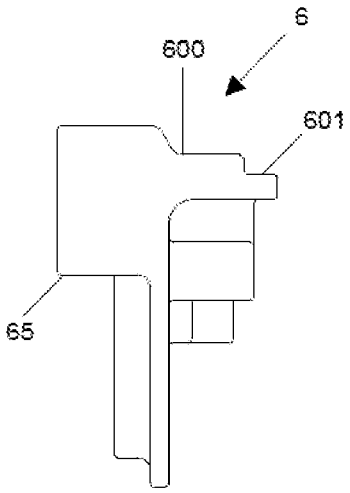
FIG. 8*c* shows a profile view of the third front plate.
Figure 8D:
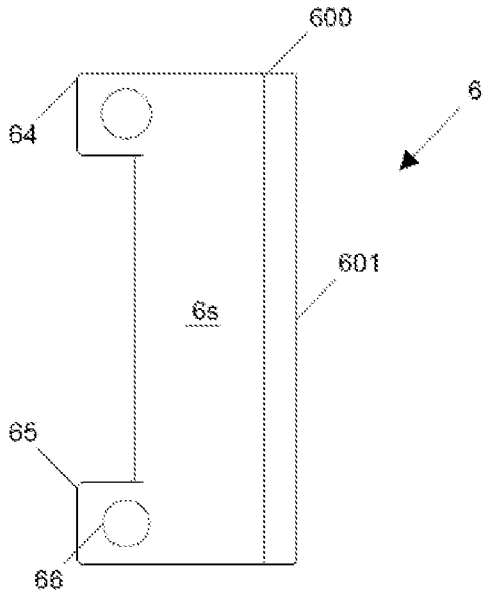
FIG. 8*d* shows a top plan view of the third front plate.
Figure 8E:
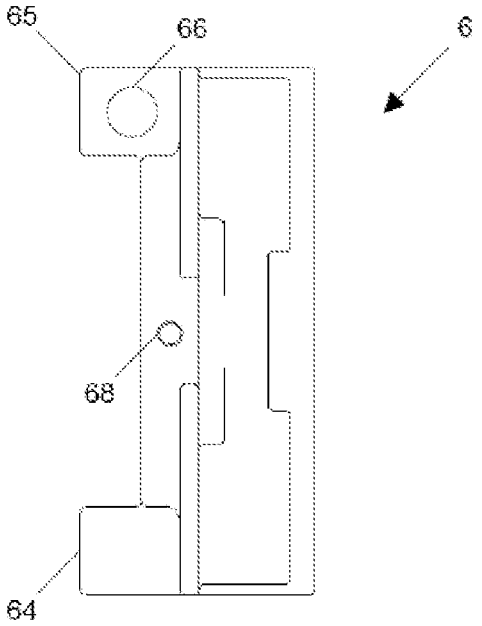
FIG. 8*e* shows a bottom plan view of the third front plate.

The third front plate (6) comprises two joining holes (62), FIG. 7, in order to enable said third front plate (6) to be coupled to the rear plate (3). Said joining holes (62) face the auxiliary holes (34) of the rear plate (3) in order to enable said third front plate (6) to be coupled to the rear plate (3) by using two third screws (63).

The third front plate (6) comprises:

- a first lateral stop (64) that protrudes perpendicularly with respect to a front face (6*f*) of the third front plate (6); and
- a second lateral stop (65), opposite from the first lateral stop (64), which protrudes perpendicularly with respect to said front face (6*f*).

Figure 14:
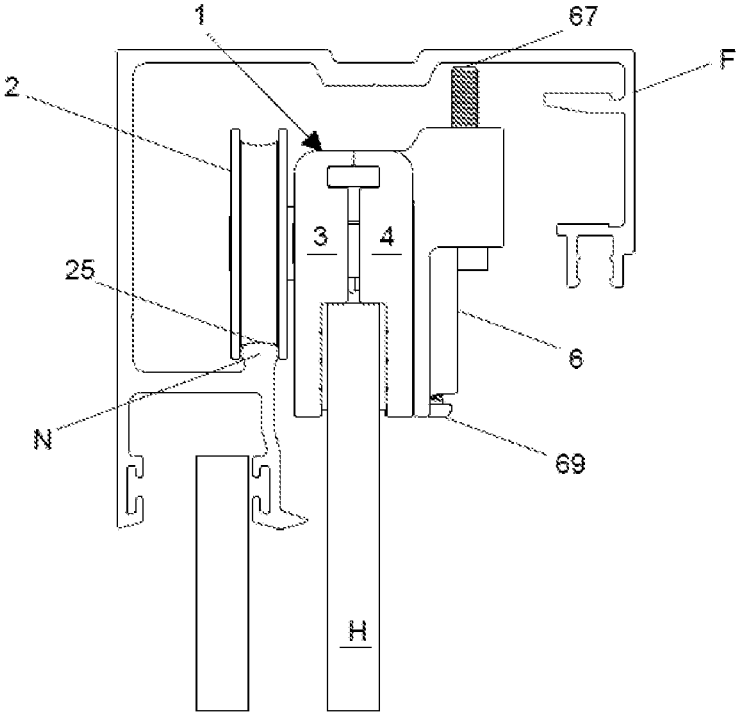
FIG. 14 shows a profile view of the securing device together with the assembly profile.

The third front plate (6) comprises:

- a threaded bushing (66) vertically inserted into the second lateral stop (65); and
- a safety screw (67) configured to be threaded into the threaded bushing (66) protruding vertically with respect to an upper face (6*s*) of the third front plate (6) in order to ensure the anti-derailment of the pane of glass (H), FIG. 14.

Figure 6:
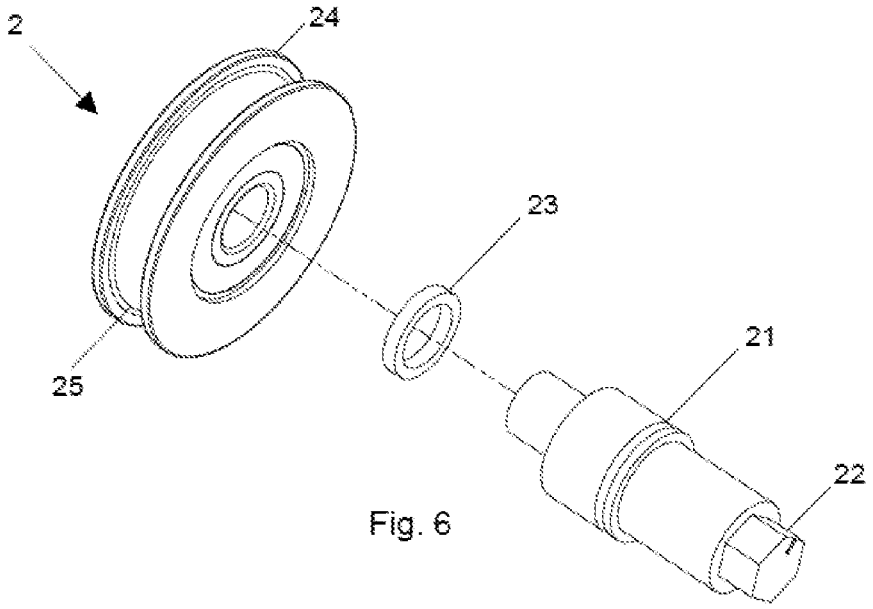
FIG. 6 shows an exploded perspective view of the rolling element.

FIG. 6 shows the configuration of the rolling element (2) in greater detail. The washer (23) ensures the fastening of the rolling element (2) to the securing device (1). The wheel (24) comprises a perimeter recess (25) configured to rest on a rolling rib (N) of the profile (F) and to move along it, FIG. 14.

FIGS. 7 and 8*a*-8*e* show the configuration of the third front plate (6) in greater detail. As seen, in order to ensure a suitable joint that is robust and compact between the rear plate (3) and the third front plate (6), it comprises an upper extension (600) that has a longitudinal recess (601) configured to fit with the auxiliary slit (35) of the rear plate (3), giving rise to a configuration of said third front plate (6) that has a substantially inverted "L" shape, FIG. 8*c*.

Figure 9A:
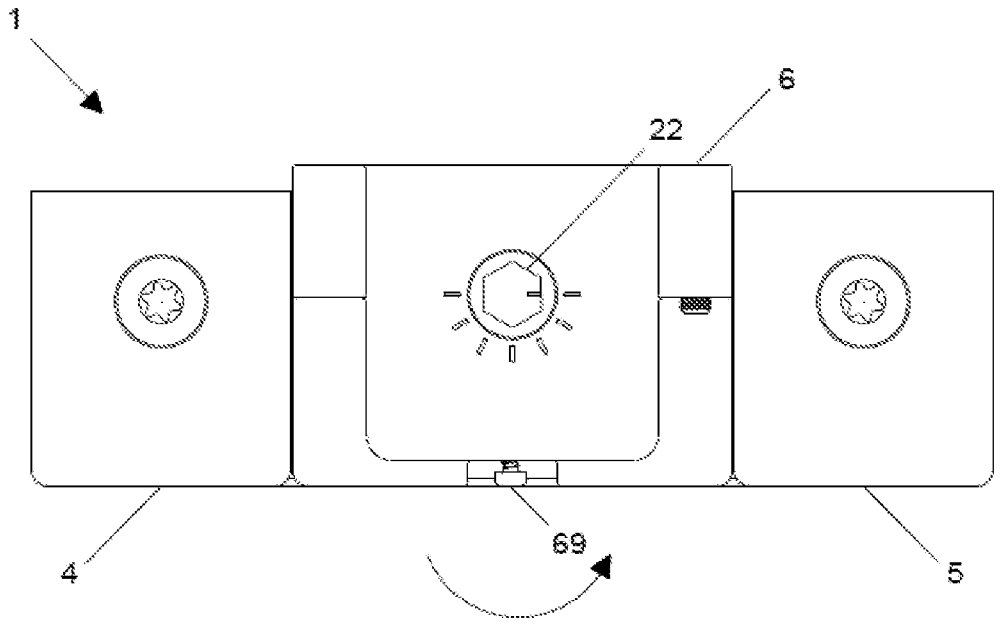
FIG. 9*a* shows a front elevation view of the securing device, reflecting a first position of the height adjustment of the rolling element with respect to the device, in which the pane of glass moves up with respect to the floor.
Figure 9B:
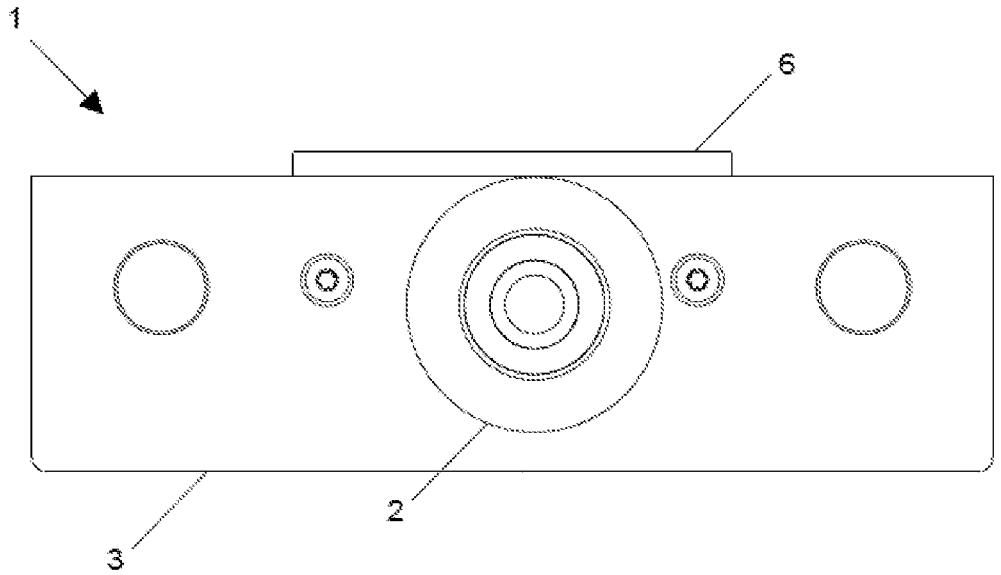
FIG. 9*b* shows a rear elevation view of the securing device of FIG. 9*a*.

FIGS. 9*a* and 9*b* show a first position of the height adjustment of the rolling element (2) with respect to the securing device (1). In this first position, the rolling element (2) is moved towards the lower portion of the securing device (1), such that when the wheel (24) rests on the rolling rib (N) the lower edge of the pane of glass (H) stays farther from the floor.

Figure 10A:
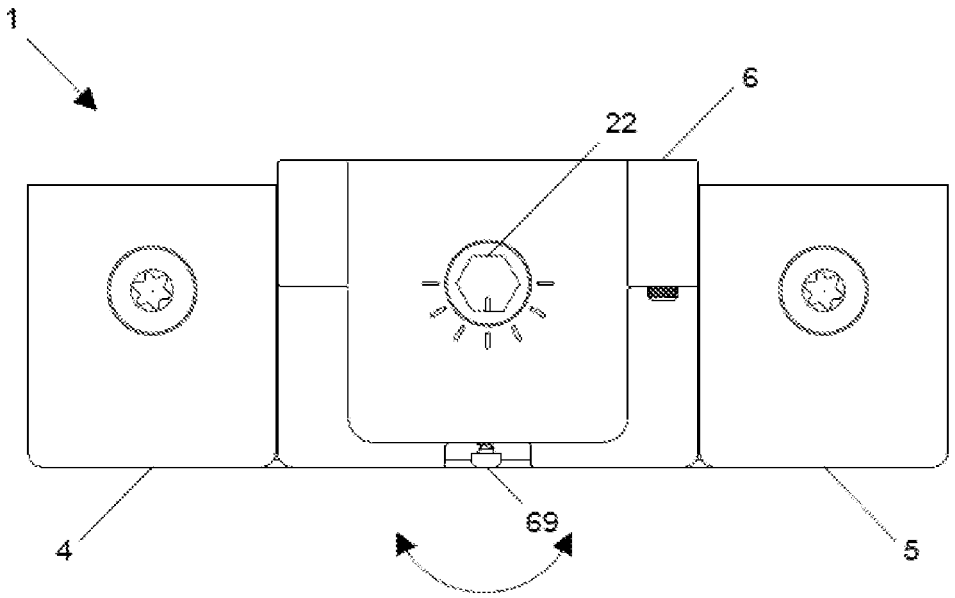
FIG. 10*a* shows a front elevation view of the securing device, reflecting a second position of the height adjustment of the rolling element with respect to the device, in which the pane of glass is in an intermediate position with respect to the floor.
Figure 10B:
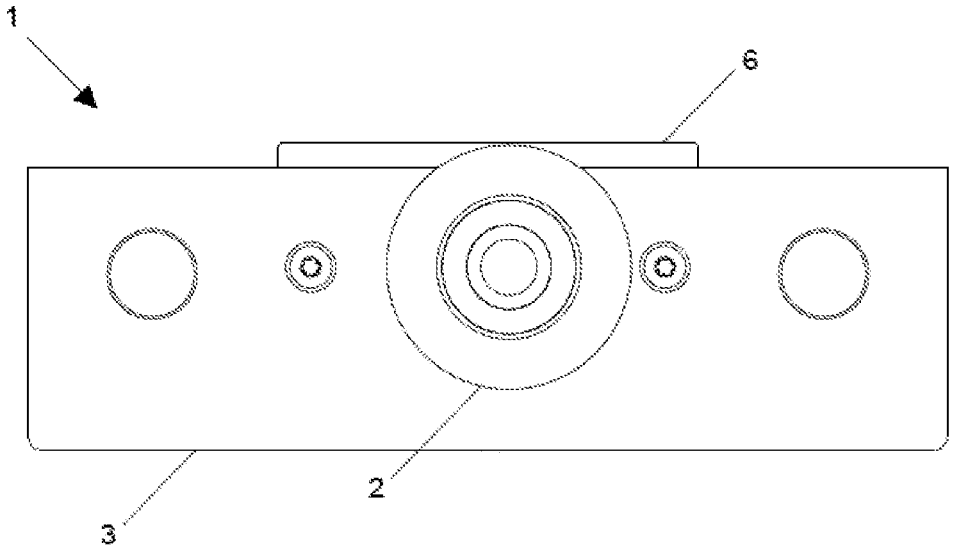
FIG. 10*b* shows a rear elevation view of the securing device of FIG. 10*a*.

FIGS. 10*a* and 10*b* show a second position of the height adjustment of the rolling element (2) with respect to the securing device (1). In this second position, the rolling element (2) is moved towards an intermediate portion of the securing device (1).

Figure 11A:
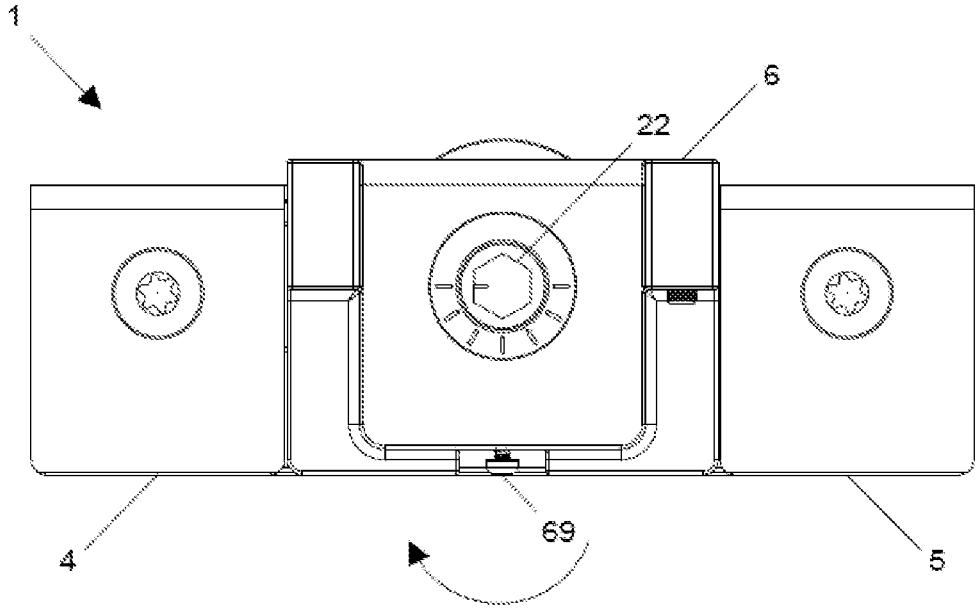
FIG. 11*a* shows a front elevation view of the securing device, reflecting a third position of the height adjustment of the rolling element with respect to the device, in which the pane of glass moves down with respect to the floor.
Figure 11B:
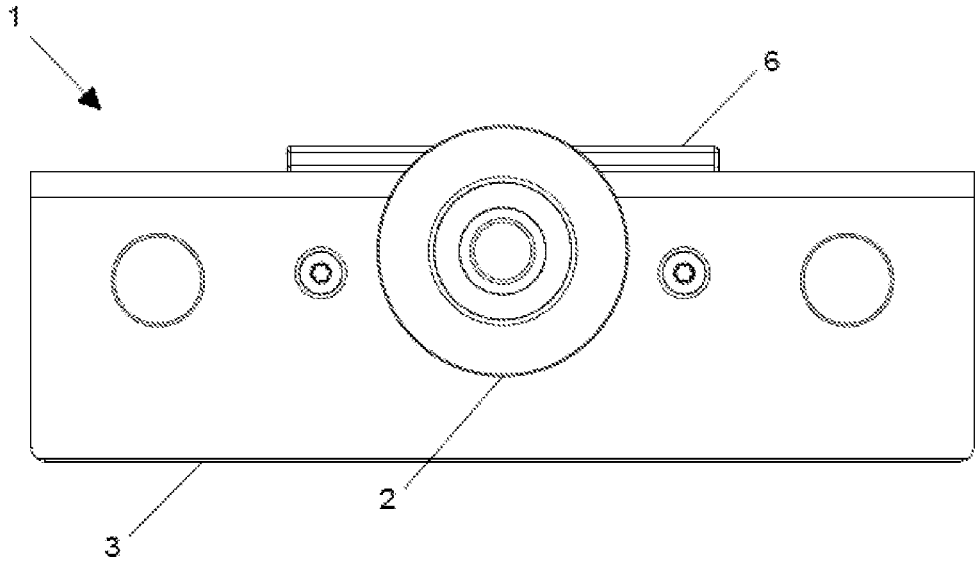
FIG. 11*b* shows a rear elevation view of the securing device of FIG. 11*a*.

FIGS. 11*a* and 11*b* show a third position of the height adjustment of the rolling element (2) with respect to the securing device (1). In this third position, the rolling element (2) is moved towards the upper portion of the securing device (1), such that when the wheel (24) rests on the rolling rib (N) the lower edge of the pane of glass (H) stays closer to the floor.

The pane of glass (H) moves up upon passing from the second position shown in FIGS. 10*a* and 10*b* to the first adjustment position shown in FIGS. 9*a* and 9*b*. On the other hand, the pane of glass (H) moves down upon passing from the second position shown in FIGS. 10*a* and 10*b* to the third adjustment position shown in FIGS. 11*a* and 11*b*. This is achieved by actuating the adjusting end (22) in order to make the eccentric shaft (21) of the rolling element (2) rotate.

Figure 12:
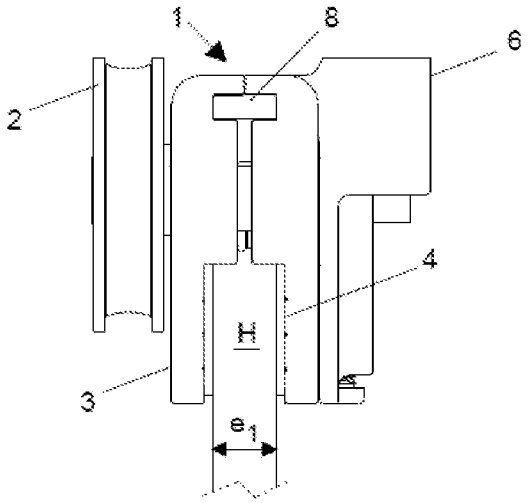
FIG. 12 shows a first profile view of the securing device, securing a pane of glass that has a first thickness.

FIG. 12 shows a first profile view of the securing device (1), securing a pane of glass (H) that has a first thickness ($e_1$), for example, 8 mm.

Figure 13:
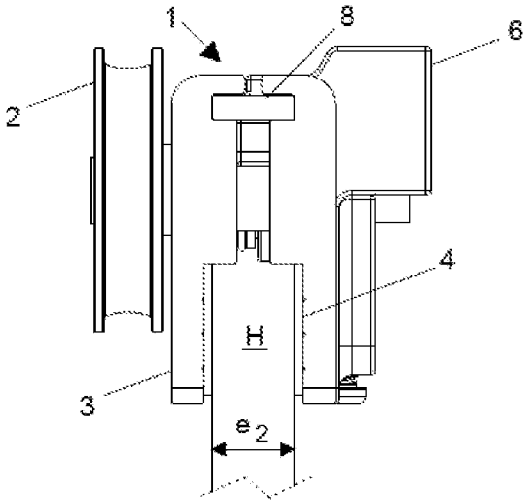
FIG. 13 shows a second profile view of the securing device, securing a pane of glass that has a second thickness greater than the first thickness.

FIG. 13 shows a second profile view of the securing device (1), securing a pane of glass (H) that has a second thickness ($e_2$) greater than the first thickness ($e_1$), for example, 12 mm. Being able to assemble one pane of glass (H) or another is achieved by changing out the separator element (8) for a larger or smaller one.

FIG. 14 shows a profile view of the securing device (1) together with the assembly profile (F), wherein it is better seen how the safety screw (67) is actuated. Specifically, the safety screw (67) can be adjusted on the threaded bushing (66), making it protrude vertically with the desired measurement. Thus, if the pane of glass (H) swings too far laterally, the upper end of the safety screw (67) butts against the profile (F) in order to stop said swinging.

Figure 15:
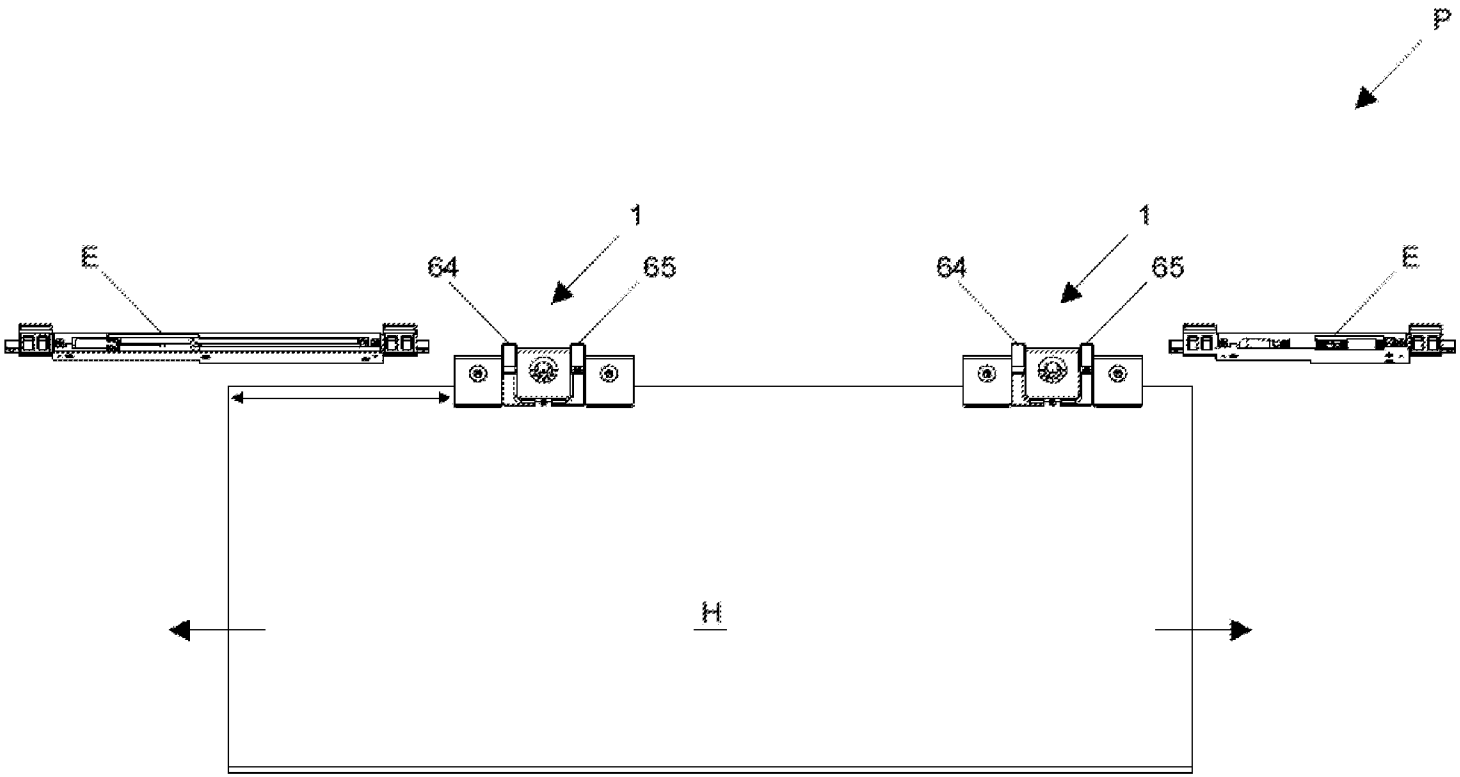
FIG. 15 shows a partial front view of a sliding door with the securing device of the present invention.

FIG. 15 shows a partial front view of a sliding door (P) with the securing device (1) of the present invention. As seen, the lateral stops (64, 65) enable the securing device (1) to work in collaboration with other auxiliary elements (E) mounted in the door (P), such as closing and/or retaining shock absorbers. This is achieved by aligning said lateral stops (64, 65) with the corresponding auxiliary elements (E) so that contact is established between them.

Figure 16:
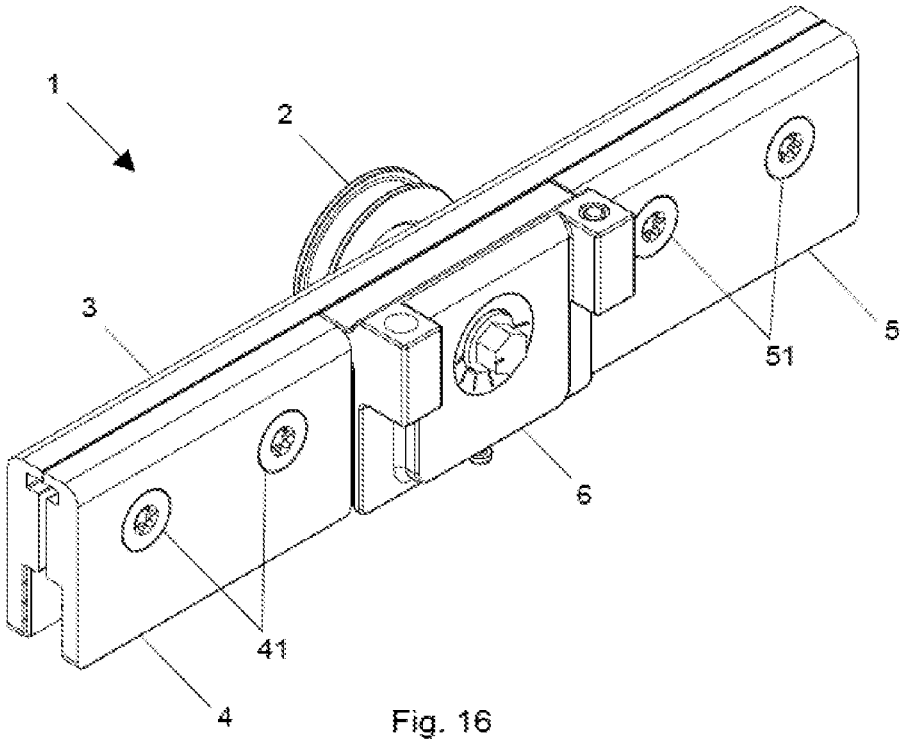
FIG. 16 shows a front perspective view of the securing device of the present invention, according to a second embodiment.
Figure 17:
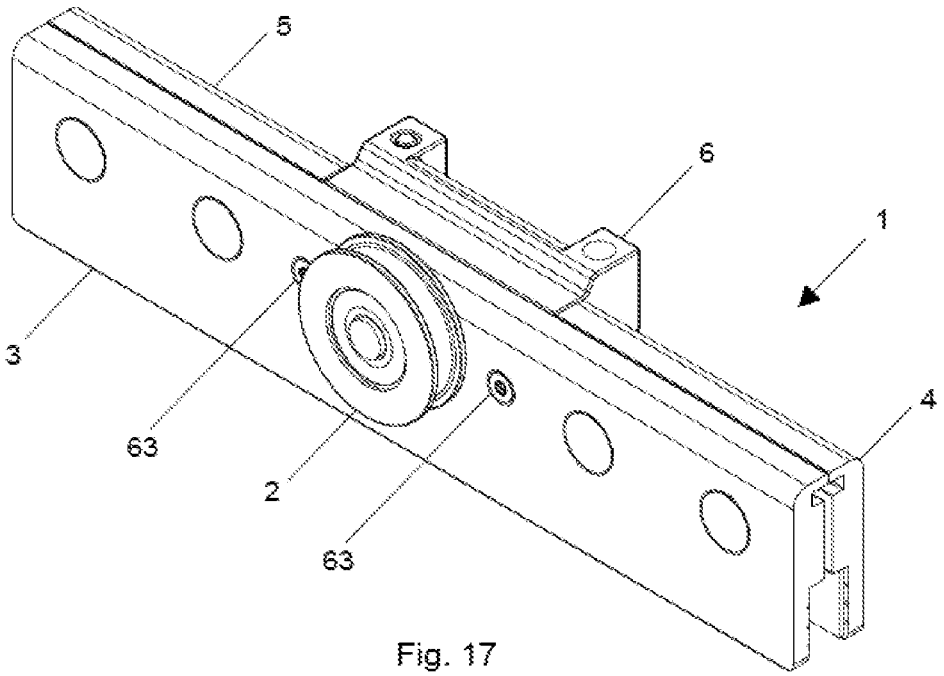
FIG. 17 shows a rear perspective view of the securing device of FIG. 16.

FIGS. 16 and 17 show the securing device (1) of the present invention, according to a second embodiment. As seen, the number of first screws (41) and second screws (51) of this securing device (1) is greater than in the first embodiment, it therefore being able to secure heavier panes of glass (H).

The invention claimed is:

1. A device for securing panes of glass for sliding doors comprising:

a rear plate made of a single part on which a rolling element is supported which is configured to enable the movement of the securing device along a profile (F) of a sliding door (P);

a first front plate and a second front plate facing the rear plate and able to be coupled to it, defining an intermediate mortise for securing a pane of glass (H); and a third front plate facing the rear plate and able to be coupled to it, arranged between the first front plate and the second front plate.

2. The device for securing panes of glass for sliding doors according to claim 1, wherein the rolling element comprises an eccentric shaft in order to enable the height said rolling element to be adjusted with respect to the device.

3. The device for securing panes of glass for sliding doors according to claim 2, wherein the rear plate comprises a supporting hole configured to receive the eccentric shaft of the rolling element through it.

4. The device for securing panes of glass for sliding doors according to claim 2, wherein the third front plate comprises a central hole.

5. The device for securing panes of glass for sliding doors according to claim 4, wherein the central hole faces the supporting hole of the rear plate in order to receive an adjusting end of the eccentric shaft of the rolling element through it.

6. The device for securing panes of glass for sliding doors according to claim 5, wherein the third front plate comprises a fastening hole that opens into the central hole, in order to enable the eccentric shaft of the rolling element to be fastened by means of a fastening screw.

7. The device for securing panes of glass for sliding doors according to claim 1, wherein the rear plate comprises:

at least one first bushing facing a first hole of the first front plate in order to enable said first front plate to be coupled to the rear plate by using a first screw; and at least one second bushing facing a second hole of the second front plate in order to enable said second front plate to be coupled to the rear plate by using a second screw.

8. The device for securing panes of glass for sliding doors according to claim 7, wherein the third front plate comprises at least one joining hole in order to enable said third front plate to be coupled to the rear plate.

9. The device for securing panes of glass for sliding doors according to claim 8, wherein the joining hole faces the auxiliary hole of the rear plate in order to enable said third front plate to be coupled to the rear plate by using a third screw.

10. The device for securing panes of glass for sliding doors according to claim 1, wherein the rear plate comprises at least one auxiliary hole arranged around the rolling element in order to enable the coupling of the third front plate.

11. The device for securing panes of glass for sliding doors according to claim 1, wherein the rear plate comprises an auxiliary slit facing a first slit of the first front plate and a second slit of the second front plate, in order to enable a separator to be inserted between said slits.

12. The device for securing panes of glass for sliding doors according to claim 1, wherein the third front plate comprises:

a first lateral stop that protrudes perpendicularly with respect to a front face of the third front plate; and a second lateral stop, opposite from the first lateral stop, which protrudes perpendicularly with respect to said front face.

13. The device for securing panes of glass for sliding doors according to claim 12, wherein the third front plate comprises:

at least one threaded bushing vertically inserted into at least one of the lateral stops; and a safety screw configured to be threaded into the threaded bushing protruding vertically with respect to an upper face of the third front plate in order to ensure the anti-derailment of the pane of glass (H).

14. The device for securing panes of glass for sliding doors according to claim 1, wherein the third front plate comprises an upper extension that has a longitudinal recess configured to fit with the rear plate.

15. The device for securing panes of glass for sliding doors according to claim 1, wherein the third front plate has a configuration with a substantially inverted "L" shape.

16. The device for securing panes of glass for sliding doors according to claim 1, wherein the third front plate is made of plastic material.

17. The device for securing panes of glass for sliding doors according to claim 1, wherein the rear plate, the first front plate and the second front plate are made of metal.

* * * * *